United States Patent [19]

Castonguay et al.

[11] Patent Number: 4,480,242

[45] Date of Patent: Oct. 30, 1984

[54] VARIABLE TORQUE CONTACT ARM FOR ELECTRIC CIRCUIT BREAKERS

[75] Inventors: Roger N. Castonguay, Terryville; Charles L. Jencks, Avon, both of Conn.

[73] Assignee: General Electric Company, New York, N.Y.

[21] Appl. No.: 479,616

[22] Filed: Mar. 28, 1983

[51] Int. Cl.[3] ..... H01H 3/00

[52] U.S. Cl. ..... 335/194; 335/15; 335/190; 200/244; 200/250

[58] Field of Search ..... 335/15, 16, 185, 186, 335/188, 189, 190, 191, 192, 193, 194, 195; 200/243, 244, 250, 251

[56] References Cited

U.S. PATENT DOCUMENTS 2,514,839 7/1950 Caswell ..... 335/195

*Primary Examiner*—E. A. Goldberg
*Assistant Examiner*—George Andrews
*Attorney, Agent, or Firm*—R. A. Menelly; W. C. Bernkopf; Fred Jacob

[57] ABSTRACT

A movable contact arm for circuit breakers allows the contact opening characteristics to be determined over an entire range of breaker ratings. The contact arm is provided with a camming surface with the contact closure spring arranged as a cam follower. Under short circuit conditions, the contact repulsion force is sufficient to overcome the bias provided by the contact closure spring and to drive the cam follower along the camming surface so that the resulting spring torque rapidly changes from a high initial torque on the contact arm to zero torque in a very short period of time. The contact arm is linked with the contact operating mechanism to open upon current overload in response to the trip mechanism.

9 Claims, 3 Drawing Figures

VARIABLE TORQUE CONTACT ARM FOR ELECTRIC CIRCUIT BREAKERS

BACKGROUND OF THE INVENTION

The invention relates to electric circuit breaker contact arm assemblies similar to that described in U.S. patent application Ser. No. (479617) entitled "Contact Arm Assemblies For Use In Electric Circuit Breakers" and to the circuit breaker operating mechanism described in U.S. Pat. No. 3,605,052 to Dimond et al. Both the Application and the Patent are incorporated herein for purposes of reference.

Since molded case electric circuit breakers are used over a wide range of continuous current ampere ratings, it is desirable for purposes of manufacture to use a standard tripping and contact operating mechanism for a particular breaker line and to increase the size of the operating components in proportion to the current rating. The circuit breaker described within the Patent to Dimond et al., for example, is useful over a range of continuous available currents from 15–150 amperes. The size of the bi-metallic elements, contacts, contact arms and contact springs would vary depending upon the particular rating.

One of the difficulties encountered with the "scaling-up" of the components size is the size restriction limited by the dimensions of the circuit breaker casing. A further difficulty arises in the nature of the severity of the qualifying tests that the higher rating breakers are subjected to, particularly the short circuit current test requirement. After subjection to short circuit test, the breaker is retested to ensure that it is still electrically as well as mechanically operable. During short circuit tests, the breaker is subjected to extreme thermal and mechanical stresses which could excessively damage the operating components.

Another difficulty encountered in breaker "scaling-up" design is the interaction of the contact spring with the movable contact arm. The purpose of the contact spring is to ensure minimum electrical resistance between the contacts when the contacts are closed. This contact spring pressure must be overcome by the operating mechanism spring when called upon to close the contacts. Most contact springs are found to exhibit an increase in spring force wherein the force on the contact arm increases as the contact arm is subjected to magnetic repulsion forces under short circuit tests. As the contact arm moves the contact to its open position the retarding contact spring force actually increases. It would be desirable therefore to provide a contact spring such that the spring force rapidly decreases under short circuit conditions while the contacts are blown open under the intense magnetic repulsion forces. The aforementioned U.S. patent application describes a movable contact arm assembly wherein the contact spring exhibits a fairly constant spring force as the contact arm moves to its fully open position. The purpose of this invention is to provide a contact operating arm assembly wherein the force biasing the contacts in a closed position rapidly approaches zero as the contact arm moves to its fully open position.

SUMMARY OF THE INVENTION

A movable contact arm is provided with camming surfaces and a reverse loop contact spring is arranged as a cam follower. The spring effectively rides along the contact arm camming surfaces during movement of the contact arm to its open position. The movement of the contact spring and the design of the cam surfaces result in a nearly zero spring torque on the contact arm immediately after subjecting the breaker to short circuit test currents.

DESCRIPTION OF THE PREFERRED EMBODIMENT

Figure 1:
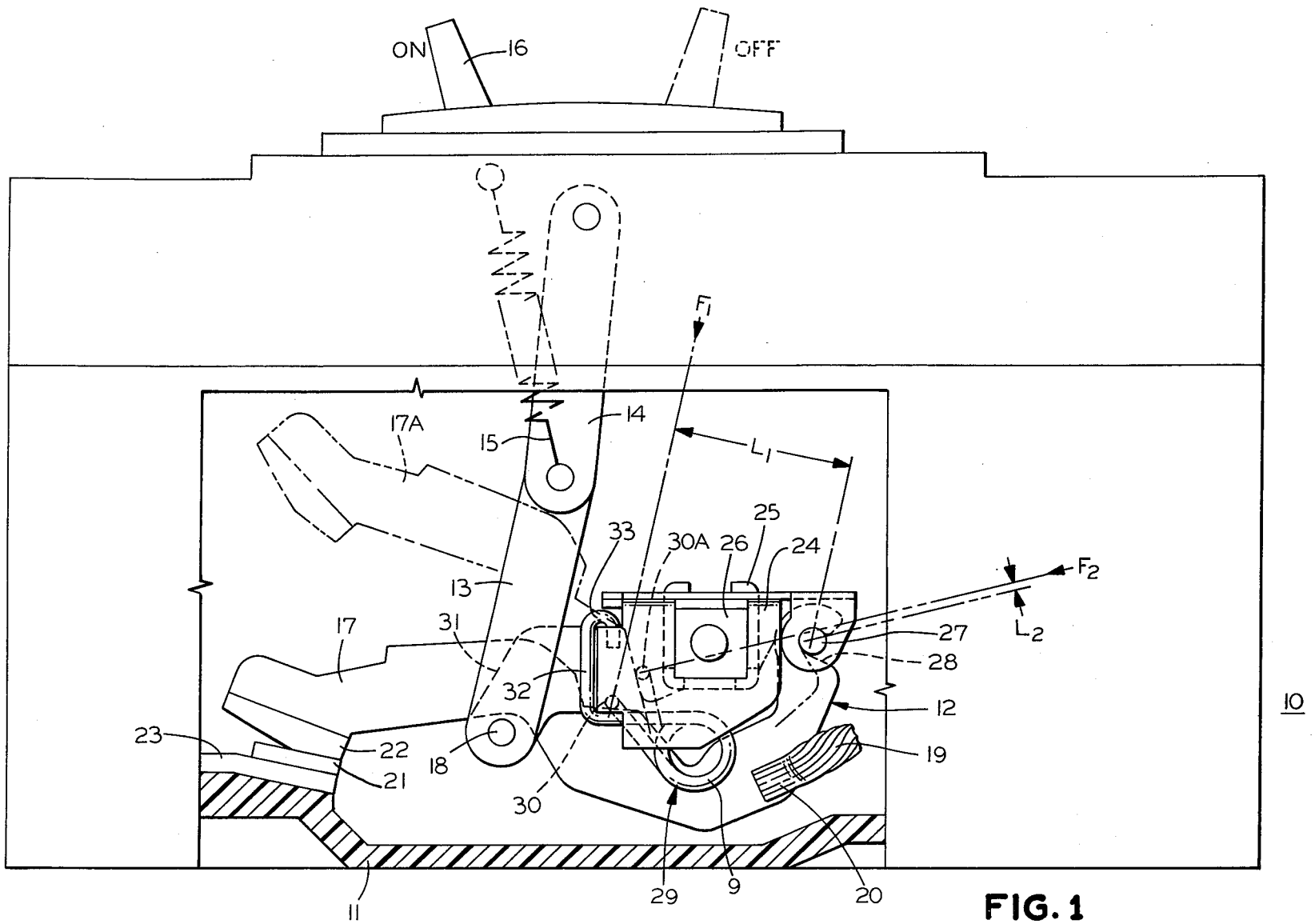
FIG. 1 is a side view of the contact arm assembly according to the invention.

FIG. 1 contains a circuit breaker 10 of the type similar to that described within the Patent to Dimond et al. and consisting of an insulated casing 11 which contains, inter alia, contact arm assembly 12. The contact assembly is connected by means of a lower link 13, upper link 14 and operating spring 15 to an on-off handle which extends through the breaker casing. In a manner similar to that described within the aforementioned referenced U.S. patent application, the movable contact arm 17, is supported by a support pin 18 which allows the contact arm to move independent from as well as in cooperation with the crossbar 26. Current path through the breaker proceeds from the load terminal (not shown) through a flexible braid 19 and through contact arm 17, fixed and movable contacts 21, 22 to line strap 23. The contact carrier 24 is fixedly attached to crossbar 26 by means of staple 25 and supports a pivot pin 27 which is captured by the contact arm pivot slot 28. The contact arm is biased downward by means of a torsion spring 29 for providing contact pressure between the fixed and movable contacts. The contact spring connects with the contact carrier leg 31 by means of spring arm 32 and spring hook 33. Spring 29 is formed from a single wire into a crossover loop where the coils 9 form the individual loops joined by a crossover arm 30. The crossover arm contacts the contact arm in such a manner that when the contact arm is moved from the closed position indicated at 17 to the open position indicated at 17A in phantom, spring end 30 moves to 30A also indicated in phantom. The contact pressure exerted by spring 29 on contact arm 17 varies in proportion to the spring torque which is defined as the product of the spring force times the operative distance of the force from the contact arm pivot pin 27. With the contact arm in its closed position the torque acting on the contact arm is equal to the spring force F1 times the separation distance L1. With the contact arm in its fully open position the torque on the arm is equal to the spring force F2 times L2, as indicated. The effective force acting on the contact arm varies from a maximum to nearly zero as the contact arm proceeds from its closed to its open position under the magnetic force exerting between contacts 21, 22 under short circuit test conditions.

Figure 2:
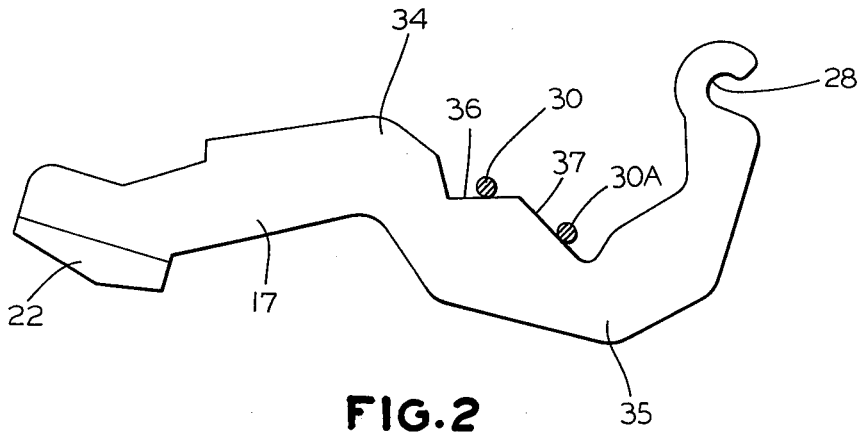
FIG. 2 is a side view of the contact arm depicted in FIG. 1.

The controlled movement of the spring crossover arm 30 along the surface of contact arm 17 can best be seen by referring now to FIG. 2. The contact arm is similar to that described in the aforementioned referenced U.S. Patent Application and has a reverse bend consisting of a knee bend 34 proximate movable contact 22 and a hook bend 35 proximate the pivot slot 28. A camming surface 36 is machined or otherwise formed on the knee bend surface and terminates at 37 which is defined as the secondary cam surface. When the contact arm 17 is in its closed position the spring crossover arm 30, which is the point of contact between the contact spring 29 (FIG. 1) and the contact arm 17, proceeds along the primary camming surface 36 to the secondary camming 37 to the position surface indicated at 30A. While the primary spring crossover arm 30 is on the camming surface 36, the spring torque is effectively equal to the spring force times the effective separation distance from the contact arm pivot point as described earlier. As soon as the crossover arm reaches the secondary camming surface 37 the spring torque on the contact arm starts to approach zero. In circuit breaker operation, the high spring torque on the contact arm results in a high contact pressure between the fixed and movable contacts while the contacts are closed i.e., when the contact arm is in a closed position and nearly zero contact pressure when the contacts are open i.e., when the contact arm is in an open position. The repulsion forces developed between the fixed and movable contacts under short circuit conditions are sufficient to rapidly move the contact arm and hence displace the spring crossover arm 30 from the primary camming surface 36 to the secondary cam surface 37 depending upon the lineal dimension of these camming surfaces. The effective contact force between the fixed and movable contacts and the rate at which the contacts separate due to repulsion forces, can be optimally designed for each breaker by simply altering the shape of the camming surfaces.

Figure 3:
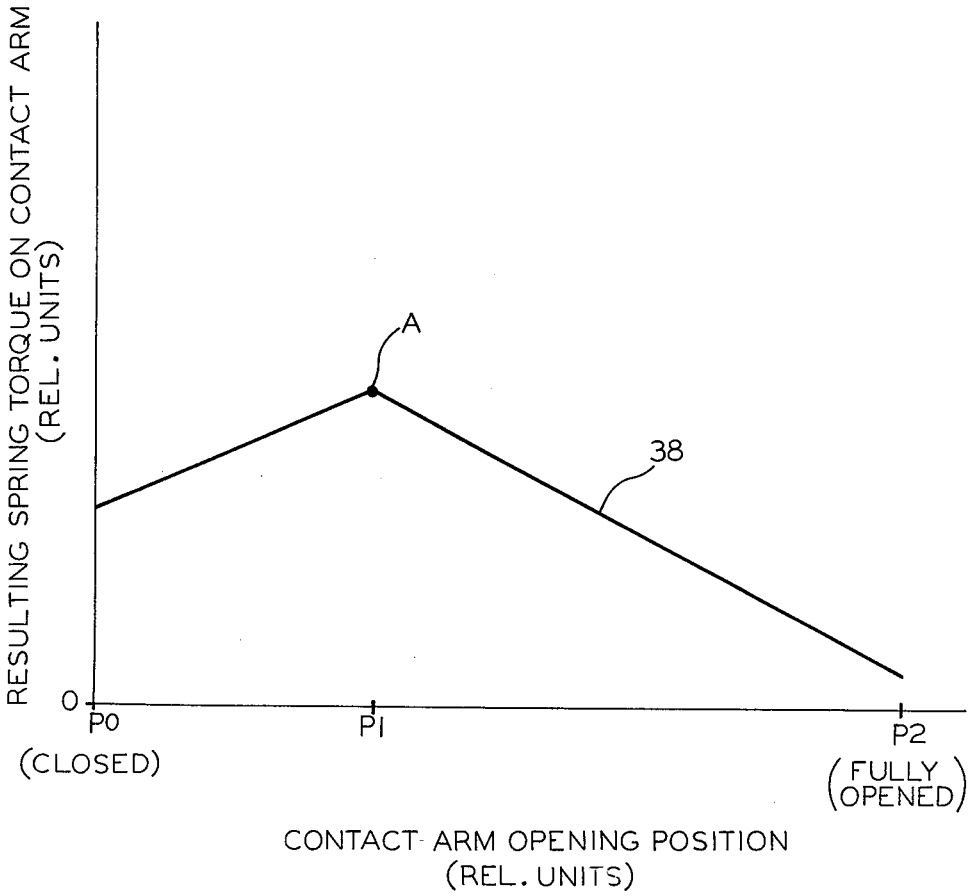
FIG. 3 is a graphic representation of the resulting contact arm torque as a function of the cam design on the contact operating arm surface.

A typical relationship between the contact arm opening position and the resulting spring torque due to the camming surfaces is shown graphically at 38 in FIG. 3. The maximum torque for the breaker depicted in FIG. 1 is shown at A for a spring having approximately six pounds of contact force initially. As the breaker contact arm 17 proceeds from a contact closed position indicated at PO, the spring crossover arm 30 moves along the contact arm primarily camming surface 36 to point P1, where the resulting spring torque on the contact arm is a pre-determined maximum indicated at A. The crossover loop then moves to the secondary camming surface 37 proceeding as indicated to the fully opened position P2. It can be seen that the spring torque at first increases along the primary camming surface to a maximum value and then decreases along the secondary camming surface. Varying the configuration of the primary and secondary camming surfaces would allow any particular contact opening characteristic to be achieved. This has never heretofore been possible without substantial modification to the breaker operating mechanism.

Having described our invention, what we claim as new and desire to secure by Letters Patent is:

1. An improved contact arm at arrangement for electric circuit breakers of the type consisting of an operating handle connected with an operating mechanism and circuit breaker contacts for both manual and automatic opening of the contacts wherein the improvement comprises:

a movable contact arm linked with said operating mechanism and pivoted at one end for opening independently of said operating mechanism; and a movable contact mounted at an opposite end of said contact arm; and a contact spring for biasing said contacts in a closed position, said contact spring being slidably coupled with said contact arm for providing a first torque on said contact arm at one location along said contact arm and a second torque on said contact arm at another location along said contact arm, both of said locations being intermediate both ends of said contact arm.

2. The improvement of claim 1 wherein said contact arm is provided with a primary camming surface and a secondary camming surface and wherein said one location is at said primary camming surface and said other location is at said secondary camming surface.

3. The improvement of claim 1 wherein said contact arm has a hook-shaped configuration comprising a knee-shaped bend and a hook-shaped bend.

4. The improvement of claim 3 wherein said knee-shaped bend is proximate a contact end of said contact arm and said hook-shaped bend is proximate said pivot end of said contact arm.

5. The improvement of claim 4 wherein said contact arm is mechanically linked with said operating mechanism by a support pin under said knee-shaped bend.

6. The improvement of claim 5 wherein said contact spring is arranged between a contact carrier and said hook-shaped bend.

7. The improvement of claim 6 wherein said contact spring comprises a cross-over loop with one side of the loop on either side of said contact arm and a cross-over arm perpendicular to said contact arm.

8. The improvement of claim 7 wherein said cross-over arm moves from said primary camming surface to said secondary camming surface as said contact arm moves from a closed to an open position.

9. The improvement of claim 1 wherein said first contact torque is greater than said second contact torque.

* * * * *